US005201464A

United States Patent [19]

File

[11] Patent Number: 5,201,464

[45] Date of Patent: Apr. 13, 1993

[54] PRESSURE SEAL C-FOLD TWO-WAY MAILER

[75] Inventor: Jerry E. File, Mundelein, Ill.

[73] Assignee: Moore Business Forms, Inc., Grand Island, N.Y.

[21] Appl. No.: 742,344

[22] Filed: Aug. 8, 1991

[51] Int. Cl.[5] ..... B65D 27/06; B65D 27/04

[52] U.S. Cl. ..... 229/305; 229/304; 229/314

[58] Field of Search ..... 229/69, 71, 73, 92.1, 229/92.3, 301, 303, 304, 305, 314, 316

[56] References Cited

U.S. PATENT DOCUMENTS

| | | | |
|---|---|---|---|
| 3,113,716 | 12/1963 | Howard | 229/73 |
| 3,228,586 | 1/1966 | Hayes, Jr. | 229/73 |
| 3,652,007 | 3/1972 | MacDougall | 229/73 |
| 3,791,572 | 2/1974 | Gendron | 229/69 |
| 3,802,618 | 4/1974 | Weissner | 229/304 |
| 3,837,565 | 9/1974 | Johnsen | 229/69 X |
| 3,981,435 | 9/1976 | Johnsen | 229/314 X |
| 3,995,808 | 12/1976 | Kehoe . | |
| 4,055,294 | 10/1977 | Traise | 229/73 X |
| 4,081,127 | 3/1978 | Steidinger | 229/69 |
| 4,375,868 | 3/1983 | Slotar et al. . | |
| 4,487,360 | 12/1984 | Fisher et al. | 229/304 |
| 4,575,121 | 3/1986 | Conti . | |
| 4,669,652 | 6/1987 | Seguin | 229/303 |
| 4,706,878 | 11/1987 | Lubotta et al. | 229/73 |
| 4,754,915 | 7/1988 | Steidinger | 229/92.7 |
| 4,756,468 | 7/1988 | Jenkins | 229/304 |
| 4,775,095 | 10/1988 | Emmott | 229/303 |
| 4,778,101 | 10/1988 | Paquin | 229/303 |
| 4,830,269 | 5/1989 | Jenkins | 229/73 |
| 4,896,823 | 1/1990 | Taylor | 229/303 |
| 4,899,926 | 2/1990 | Spaulding | 229/304 |
| 4,915,287 | 4/1990 | Volk et al. | 229/70 |
| 4,960,237 | 10/1990 | Bendel | 229/73 |

FOREIGN PATENT DOCUMENTS

| | | | |
|---|---|---|---|
| 804433 | 1/1969 | Canada . | |
| 2400465 | 4/1979 | France . | |
| 2409920 | 7/1979 | France | 229/92.1 |
| 337326 | 3/1936 | Italy | 229/92.1 |
| 1507667 | 9/1989 | U.S.S.R. . | |
| 535485 | 4/1941 | United Kingdom . | |

OTHER PUBLICATIONS

Z-fold SPEEDISEAL®, demonstration form, 1991 (month unknown).

C-fold SPEEDISEAL®, demonstration form, 1991 (month unknown).

Z-fold SPEEDISEAL® form. (month & year unknown).

Moore brochure "The SpeediSealer® Pressure Seal System For Nonimpact Printers", Jun. 1990.

Moore Paragon "The PostMatic 830" brochure, Feb. 1979.

Moore "Pressure Seal . . . A New Age in Mailing Technology" brochure, Dec. 1990.

Moore Paragraph "an Introduction to Pressure Seal . . . " brochure, Oct. 1990.

*Primary Examiner*—Allan N. Shoap
*Assistant Examiner*—Jes F. Pascua
*Attorney, Agent, or Firm*—Nixon & Vanderhye

[57] ABSTRACT

A C-fold simple mailer is provided which may be processed on a laser (or other non-impact) printer. Pressure sensitive adhesive is utilized to form the mailer, and integral return envelope. C-folding and sealing are effected after printing of variable data on the form. In one construction variable data is printed on both faces of the form utilizing a duplex sheet feed laser printer, while in a second construction a simplex continuous laser printer is utilized and variable data—including the outgoing addressee address indicia—is printed on only one face. In the second construction a die cut window is provided so that the outgoing address information is visible from the exterior of the mailer.

19 Claims, 4 Drawing Sheets

PRESSURE SEAL C-FOLD TWO-WAY MAILER

BACKGROUND AND SUMMARY OF THE INVENTION

It is desirable to be able to make simple mailers utilizing non-impact printers (such a laser printers). One way to accomplish that result is to utilize simple C-fold constructions, with integral return envelopes, such as shown in U.S. Pat. Nos. 4,896,823 and 4,915,287. Such constructions typically utilize heat seal adhesive. Heat seal adhesive presents many practical difficulties in use in some establishments, often requiring heat sealing before printing with a laser printer (which generates heat). Also, typical prior art constructions—such as shown in U.S. Pat. No. 4,896,823—can be unacceptable as a reusable mailer because the original bar code remains on the face of the return envelope. If address block bar coding is officially accepted, then such a reusable mailer can be used, but only with non-impact printers which can image the bar code in the address block.

According to the present invention, an advantageous simple mailer type business form, with integral return envelope, is provided, as well as an intermediate of such a form, and methods of construction thereof. According to the present invention, the return envelope is created during the folding and sealing process as opposed to prefolding the form prior to printer imaging, or attaching a separate envelope or additional paper ply that forms an envelope. Also, the invention preferably utilizes pressure seal adhesive which eliminates the necessity for heat sealing, and the mess of applying glue or water during the folding and sealing process. Two different constructions are provided according to the invention, one construction allowing the nesting of inserts in the mailer, and the other construction allowing simplex imaging.

Both constructions according to the invention have many uses. One exemplary use for the first construction is in periodical subscription billing wherein the billing is prepared on a cut sheet laser printer having duplex imaging capabilities which prints the billing information on a first face of the sheet, and address information on the second sheet. Informational or promotional inserts can be nested in the mailer. An exemplary use of the second construction is a payment past due notice which is imaged on a continuous laser printer or a cut sheet with simplex laser printer, all the printing being done by the non-impact printer on the first face of the sheet, with address information visible through the die cut window.

With either inventive construction, after laser printer imaging of variable information the forms are processed on conventional pressure seal equipment, such as the SpeediSealer® pressure seal equipment marketed by Moore Business Forms, and are subsequently mailed. The recipient opens the mailer by removing stubs on the left and right edges and then unfolds it to reveal confidential information within it. The top panel can then be removed via a perforation, and a remittance stub removed from the top panel and inserted in the return envelope, which then may be sealed with rewettable adhesive and mailed.

According to one aspect of the present invention, a mailer type business form intermediate is provided. The intermediate comprises: A sheet of paper having a first face, adapted to provide the majority of the interior of the mailer when constructed, and a second face, adapted to provide the majority of the exterior of the mailer when constructed, the sheet having first and second opposite, parallel, longitudinal edges, and opposite ends. First and second longitudinal lines of weakness formed in the sheet parallel to and adjacent, but spaced from, the first and second longitudinal edges, respectively, the lines of weakness defining, with the longitudinal edges, longitudinal marginal portions. First and second longitudinal strips of adhesive disposed in the first and second longitudinal marginal portions, respectively, of the first face, extending the majority of the lengths of the longitudinal marginal portions, and parallel to the first and second longitudinal edges. Third and fourth longitudinal strips of adhesive disposed parallel to the first and second strips, and disposed adjacent the first and second lines of weakness on the opposite side thereof from the first and second strips, on the first face, the third and fourth longitudinal strips disposed closer to one end of the ends than the other, and extending a distance substantially less than the extent of the first and second strips. Means defining a transverse adhesive strip on the first face, perpendicular to the third and fourth strips, longitudinally spaced from the third and fourth strips; and means defining a line of weakness adjacent the transverse strip, on the opposite side thereof from the third and fourth strips, to allow ready separation of the paper at that line.

The adhesive strips are preferably pressure sensitive adhesive. The intermediate also preferably comprises fifth and sixth longitudinal strips of adhesive parallel to the first and second longitudinal edges and disposed in the first and second marginal portions, respectively, on the second face. A first transverse fold line forming means is also preferably disposed in the sheet at about the midpoint of the third and fourth adhesive strips, which are discontinuous thereat. The transverse adhesive strip is preferably rewettable glue.

The invention also contemplates a mailer type business form within integral return envelope. Such a form comprises: A C-folded paper sheet having first and second faces, first and second opposite longitudinal edges, and first and second transverse fold lines defining first, second, and third sections of the sheet (the second and third sections are larger than the first section). First and second lines of weakness formed in the sheet parallel to and adjacent, but spaced from, the first and second longitudinal edges, respectively, the lines of weakness defining, with the longitudinal edges, longitudinal marginal portions. First and second longitudinal strips of adhesive disposed in the first and second longitudinal marginal portions, respectively, of the first face, and parallel to the first and second longitudinal edges, the first and second longitudinal strips connecting at least the first and second sections, and the third and first sections, together at the longitudinal marginal portions. Third and fourth longitudinal strips of adhesive disposed parallel to the first and second strips, and disposed adjacent the first and second lines of weakness on the opposite side thereof from the first and second strips, on the first face, the third and fourth longitudinal strips connecting the first section to a part of the second section to form the sides of a return envelope. Means defining a transverse adhesive strip on the first face, perpendicular to the third and fourth strips, in the third section. Means defining a transverse line of weakness adjacent the transverse strip in the third section, on the opposite side thereof from the second section, to allow ready separation of the form at that line; and outgoing address, and outgoing return address, indicia, visible from the third section second face.

The longitudinal strips of adhesive are preferably pressure sensitive adhesive. Also, there preferably is provided a longitudinal line of weakness in the third section, intersecting the transverse line of weakness, and a third transverse fold line between the first and second lines in the second section. The outgoing addresses address indicia may be printed on the first face in the second section with a die cut window in the third section allowing viewing of the outgoing address information therethrough. Alternatively, the outgoing addressee address indicia is printed on the second face in the third section.

The invention also contemplates the methods for constructing two different constructions of C-fold mailer type business forms according to the invention.

According to a first method, a mailer type business form with integral return envelope is constructed from a sheet of paper having first and second parallel longitudinal edges, first and second parallel transverse edges perpendicular to the longitudinal edges, and first and second faces. The method comprises the steps of: (a) Forming first and second longitudinal lines of weakness in the sheet parallel to and adjacent, but spaced from, the first and second longitudinal edges, respectively, the lines of weakness defining, with the longitudinal edges, longitudinal marginal portions. (b) Providing first and second longitudinal strips of pressure sensitive adhesive in the first and second longitudinal marginal portions, respectively, of the first face, extending parallel to the first and second longitudinal edges. (c) Providing third and fourth longitudinal strips of pressure sensitive adhesive disposed parallel to the first and second strips, and disposed adjacent the first and second lines of weakness on the opposite side thereof from the first and second strips, on the first face, the third and fourth longitudinal strips disposed closer to the first transverse edge than the second. (d) Providing a transverse adhesive strip on the first face, perpendicular to the longitudinal edges, and longitudinally spaced from the third and fourth strips. (e) Providing a line of weakness adjacent the transverse strip, on the opposite side thereof from the third and fourth strips, to allow ready separation of the paper at that: line. (f) Providing first and second transverse fold lines, the first fold line closer to the first transverse edge and the second fold line closer to the second transverse end, to define a first section between the first transverse edge and the first fold line, a second section between the first and second fold lines, and a third section between the second fold line and second transverse edge. (g) Feeding the sheet to a non-impact duplex printer to print indicia on both the first and second faces, including outgoing addressee address indicia on the second face in the third section, and return envelope addressee indicia on the second face in the first section. (h) Folding the sheet so that the first section first face overlies a part, but not all, of the second section first face, and the marginal portions thereof are in engagement, and so that the third section first face overlies a portion of the second section first face, and all of the first section second face, with the marginal portions thereof in engagement; and applying pressure to the sheet at the longitudinal strips of pressure sensitive adhesive to seal the sheet into a mailer, the first and second sections forming a return envelope and all of the sections forming an outgoing mailer.

According to the second method of the invention, a mailer type business form within integral return envelope is constructed from a sheet of paper having first and second parallel longitudinal edges, and first and second parallel transverse edges perpendicular to the longitudinal edges, having first and second faces. The second method comprises the steps of: (a) Forming first and second longitudinal lines of weakness in the sheet parallel to and adjacent, but spaced from, the first and second longitudinal edges, respectively, the lines of weakness defining, with the longitudinal edges, longitudinal marginal portions. (b) Providing first and second longitudinal strips of pressure sensitive adhesive in the first and second longitudinal marginal portions, respectively, of the first face, extending parallel to the first and second longitudinal edges. (c) Providing third and fourth longitudinal strips of pressure sensitive adhesive disposed parallel to the first and second strips, and disposed adjacent the first and second lines of weakness on the opposite side thereof from the first and second strips, on the first face, the third and fourth longitudinal strips disposed closer to the first transverse end than the second. (d) Providing a transverse adhesive strip on the first face, perpendicular to the third and fourth strips, longitudinally spaced from the third and fourth strips. (e) Providing a line of weakness adjacent the transverse strip, on the opposite side thereof from the third and fourth strips, to allow ready separation of the paper at that line. (f) Providing first and second transverse fold lines, the first fold line closer to the first transverse edge and the second fold line closer to the second transverse edge, to define a first section between the first transverse edge and the first fold line, a second section between the first and second fold lines, and a third section between the second fold line and second transverse edge. (g) Die cutting a window in the third section at the portion thereof adapted to overlie outgoing addressee address indicia once the mailer is formed. (h) Feeding the sheet to a non-impact simplex printer to print indicia on only the first face, including outgoing addressee address indicia on the first face in the second section. (i) Folding the sheet so that the first section first face overlies a part, but not the outgoing address indicia, of the second section first face, and the marginal portions thereof are in engagement, and so that the third section first face overlies a portion of the second section first face so that the outgoing address indicia is visible through the window in the third section, and all of the first section second face, with the marginal portions thereof in engagement; and applying pressure to the sheet at the longitudinal strips of pressure sensitive adhesive to seal the sheet into a mailer, the first and second sections forming a return envelope and all of the sections forming an outgoing mailer.

It is the primary object of the present invention to provide a simple, easily constructed, yet very functional and versatile mailer type business form with integral return envelope. This and other objects of the invention will become clear from an inspection of the detailed description of the invention, and from the appended claims.

DETAILED DESCRIPTION OF THE DRAWINGS

Figure 1:
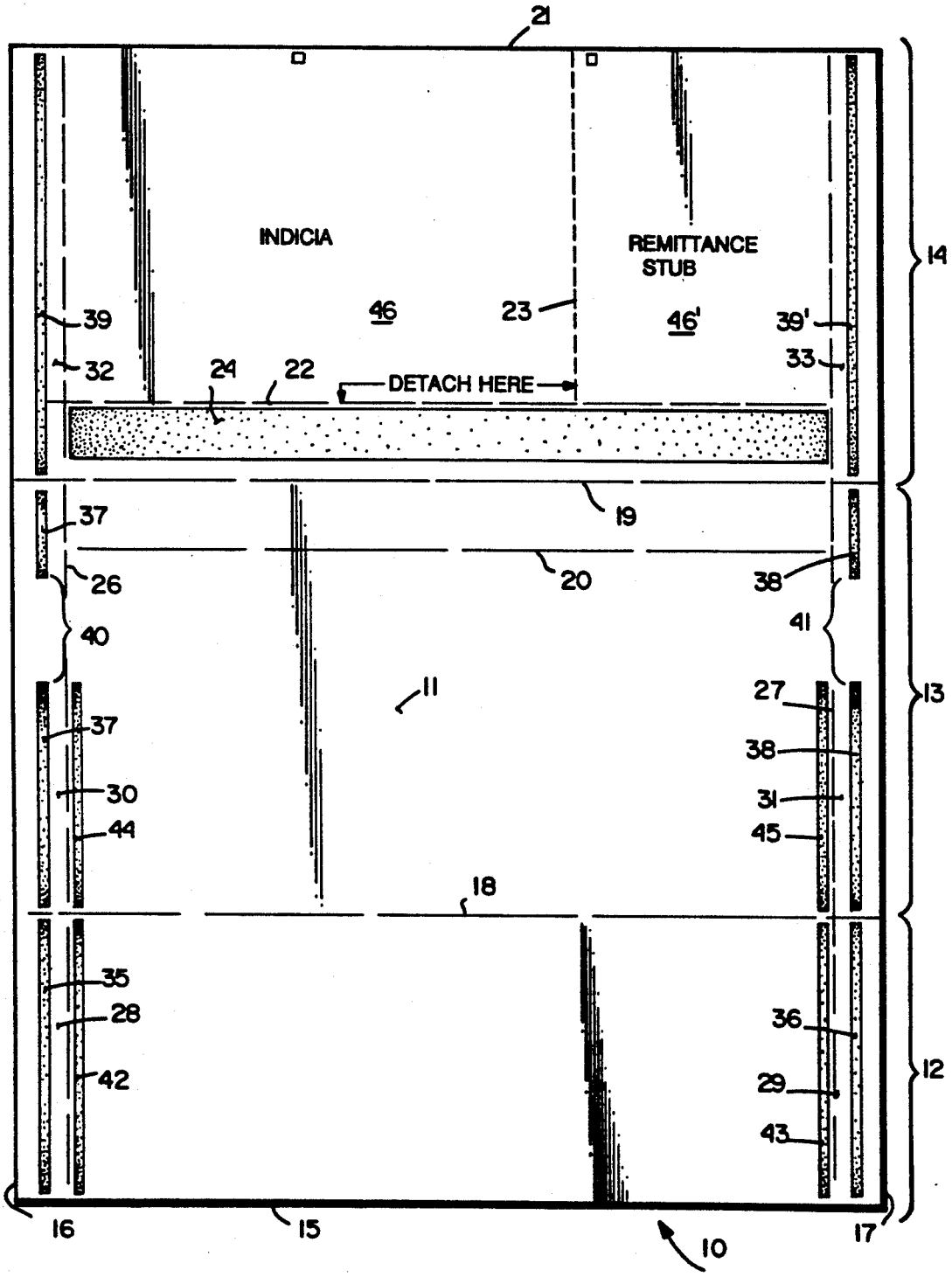
FIG. 1 is a top plan view of a first face of first exemplary mailer type business form intermediate according to the invention.
Figure 2:
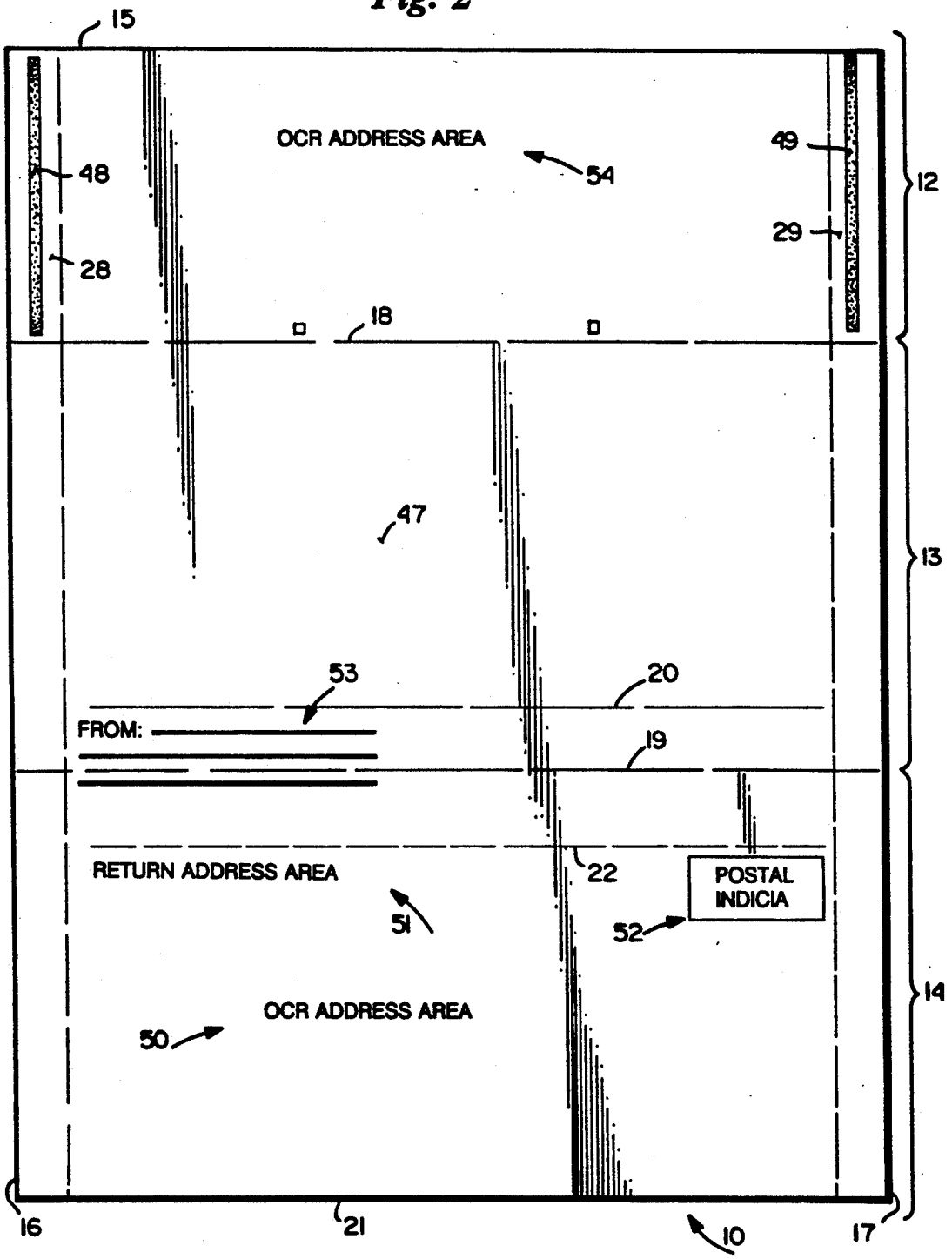
FIG. 2 is a view like that of FIG. 1 only of the second face.

A first construction of an exemplary mailer type business form intermediate according to the invention is illustrated generally by reference numeral 10 in FIGS. 1 and 2. A first face 11 of the intermediate is illustrated in FIG. 1, which is ultimately formed into first, second, and third sections 12 through 14, respectively. The intermediate 10 has a first transverse end, in this case a transverse edge 15 (since the intermediate 10 is a cut paper sheet), and it has longitudinal first and second edges 16, 17, which are parallel to each other and perpendicular to the first transverse edge 15. The first through third sections 12 through 14 are formed by first and second transverse fold lines 18, 19, respectively. A third transverse fold line 20 may also be provided in the second section 13, adjacent the second transverse line 19 Opposite the first transverse edge 15 is a second transverse edge 21, also perpendicular to the longitudinal edges 16, 17. The first section 12 is defined by the edge 15 and fold line 18, the second section 13 by the fold lines 18, 19, and the third section 14 by the fold line 19 and edge 21.

The intermediate 10 preferably also comprises a line of weakness—such as a perforation—22 disposed in the third section 14, spaced from and parallel to the second fold line 19, and a longitudinal line of weakness 23—such as a perforation—may be provided in the third section 14, intersecting the transverse line of weakness 22. Below the transverse line of weakness 22, and between it and the fold line 19, is a transverse strip of adhesive 24, which preferably comprises rewettable glue.

The intermediate 10 also comprises first and second longitudinal lines of weakness 26, 27, such as perforations, formed in the paper sheet and parallel to and adjacent, but spaced from, the longitudinal edges 16, 17, respectively. The lines of weakness 26, 27 define—with the longitudinal edges 16, 17—longitudinal marginal portions, including the longitudinal marginal portions 28, 29 in the first section 12, 30, 31 in the second section 13, and 32, 33 in the third section 14.

The intermediate 10 also comprises first and second longitudinal strips of adhesive disposed in the longitudinal marginal portions of the first face 11 and extending the majority length of the marginal portions and parallel to the longitudinal edges 16, 17. The first and second strips are interrupted at the fold lines 18, 19, and perhaps elsewhere. The first longitudinal strip comprises the adhesive sections 35, 37 and 39, formed in the first, second, and third sections 12 through 14, respectively, while the second longitudinal strip comprises the sections 36, 38, 39', again formed in the first through third sections 12 through 14, respectively. Discontinuities 40, 41 are disposed in the adhesive strip sections 37, 38, respectively, in the second section 13 merely to facilitate engagement of the friction feeding mechanism of most conventional cut sheet laser printers at that area, which eliminates the possibility of adhesive flaking off and contaminating sensitive printer components. If the intermediate 10 is used with a continuous laser printer, or a type of printer not requiring the same type of friction feeding mechanism, then the discontinuities 40, 41 need be provided.

While the longitudinal adhesive strip sections 35 through 39' are illustrated in FIG. 1 as extending essentially the entire length of the face 11, depending on the particular type of adhesive utilized and the end requirements, it may only be necessary for the adhesive to extend about half of the length of face 11.

The intermediate 10 also comprises third and fourth longitudinal strips of adhesive disposed parallel to the first and second strips of adhesive, and disposed adjacent the first and second lines of weakness 26, 27, respectively, on opposite sides thereof from the first and second strips of adhesive, on the first face, 11. The third and fourth longitudinal strips of adhesive are disposed closer to first end 15 than to second end 21, and extend a distance substantially less than the extent of the first and second strips of adhesive. In fact, typically the third and fourth longitudinal strips of adhesive extend longitudinal distance slightly less than half (e.g., about 45%) of the length of the edges 16, 17. The third longitudinal strip of adhesive is illustrated by portions 42, 44 in FIG. 1, in sections 12, 13 respectively, while the fourth longitudinal strip of adhesive is illustrated by portions 43, 45 in the sections 12, 13, respectively. The sections 42, 44 and 43, 45, respectively, are coextensive. Depending upon the particular type of adhesive, only one of the sections 42, 44 or 43, 45 need be provided.

It is preferred according to the present invention that the adhesive used to form all of the longitudinal strips—e.g., the adhesive for strip portions 35 through 39', and 42 through 45—be a pressure sensitive adhesive, such as for use with conventional pressure seal equipment, such as the SpeediSealer® pressure seal equipment marketed by Moore Business Forms. One example of such an adhesive is that marketed by Toppan Moore of Japan under the trade designation TN-124, which is a styrene-natural rubber copolymer. Another commercially available adhesive that may be utilized is the Fuller HL-9016 adhesive. Other pressure sensitive adhesive compositions which may be satisfactory are those shown in U.S. Pat. Nos. 3,041,308; 3,444,269; 3,449,471; 3,862,913; 4,228,256; 4,471,082; 3,644,579; 3,849,358; 4,483,951; and 4,397,992.

The intermediate 10 includes an upper portion detachable along the perforation 22, as illustrated by reference numeral 46, with a remittance stub portion or the like, 46', to the right of the longitudinal perforation 23 as seen in FIG. 1. The portions 46, 46' are detached by the recipient of the mailer type business form constructed from the intermediate 10, and the remittance stub 46' is returned in the integral return envelope.

FIG. 2 illustrates the second face, 47, of the intermediate 10. On the second face 47 it is preferred that fifth and sixth longitudinal pressure sensitive adhesive strips 48, 49 are provided in the marginal portion sections 28, 29, respectively, of the adhesive second face 47. The strips 48, 49 are aligned with the adhesive strip sections 39, 39', although they extend less than the distance thereof, extending the length of the first section 12, which is less than that of the second and third sections 13, 14. The adhesive strips 48, 49 are not always necessary, depending upon the particular type of adhesive utilized, but typically are provided when the pressure sensitive adhesives TN-124, or HL-9016—described above—are utilized.

On the second face 47, outgoing addressee address information 50 is printed by a non-impact printer in the third section 14, as is return address information 51 also printed in the third section 14 second face 47, and a postal indicia area 52 is provided (or printed) opposite the return address information 51. Also, indicia facilitating and suggesting the insertion of return address information on a return envelope form from the intermediate 10 is printed as indicated at 53, by a non-impact printer on the face 47, typically overlapping the second section 13 and third section 14 thereof, as illustrated in FIG. 2. Finally, the laser printer will print address information for the return envelope, as illustrated at 54 in FIG. 2, in the first section 12 on the second face 47.

Figure 3:
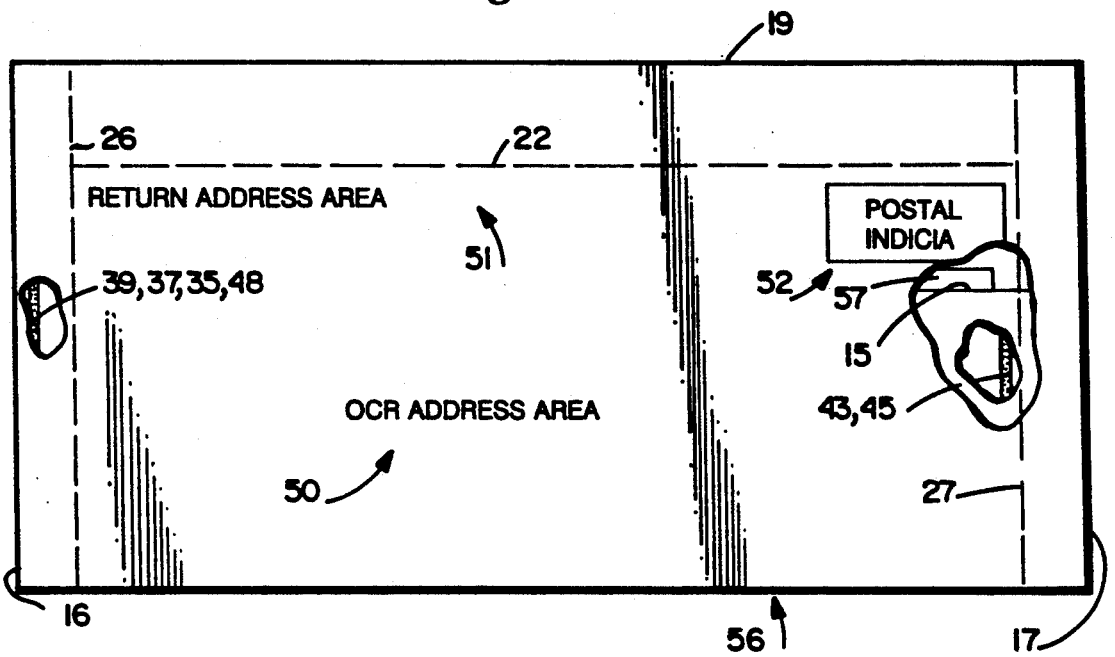
FIG. 3 is a top plan view, with portions cut away for clarity of illustration of the underlying components, of the outgoing mailer type business form according to the invention constructed from the intermediate of FIGS. 1 and 2.

FIG. 3 illustrates a C-fold mailer type business form, with the integral return envelope, 56 according to the invention. As is readily apparent from FIG. 3, after printing on a laser printer, the form 56 is constructed by folding the sheet at the first fold line 18 so that the first face 11 of the first section 12 overlies a part of the first face of the second section 13, and then folding the sheet at the second fold line 19 so that the third section 14 first face overlies a portion of the second section 13 first face, and the entire first section 12 second face 47. In this position, the glue strip sections 35, 37, 39, and 48 are aligned, the glue strip sections 42, 44, are aligned, the glue strip sections 36, 38, 39' and 49 are aligned, and the glue strip sections 43, 45 are aligned. The outgoing envelope address information 50 is readily visible on the exterior of the mailer 56, and covers the return envelope address information 54.

When the mailer 56 is constructed, one or two inserts 57 may be provided if desired.

Figure 4:
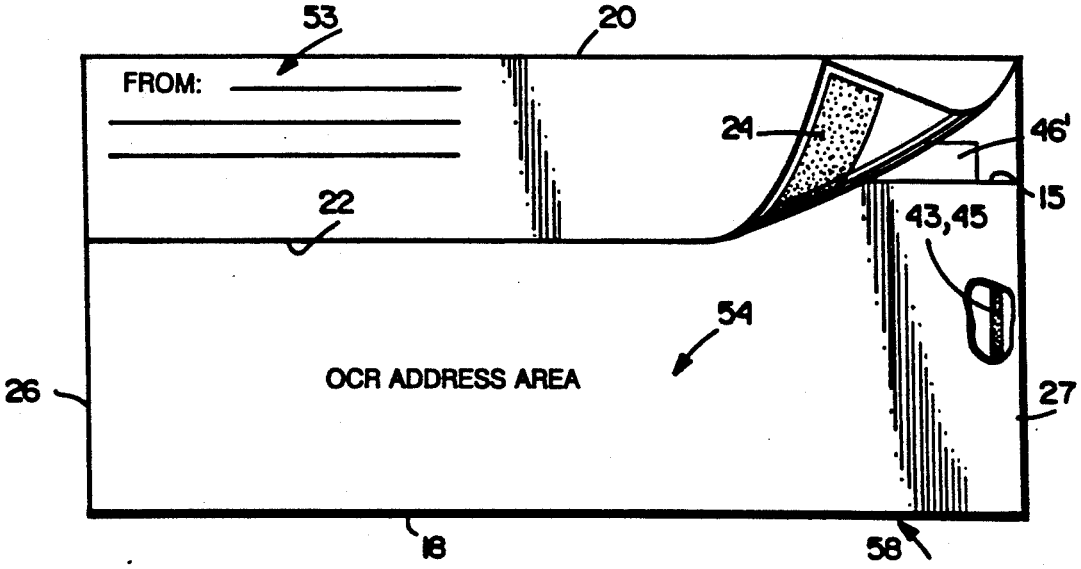
FIG. 4 is a view like that of FIG. 3 for the return envelope portion of the mailer of FIG. 3, ready for return mailing.

FIG. 4 illustrates the integral return envelope 58, which is detachable from the mailer 56. When the addressee of the mailer 56 receives it, he or she removes the longitudinal marginal portions 28 through 33 by detachment along the perforations 26, 27, detaches the portions 46, 46' by separating the sheet at the perforations 22, 23, and then inserts the remittance stub portion 46' into the return envelope 56, between the first face of the first section 12 and the first face of the second section 13. When the user is ready to seal the return envelope 56, he or she merely wets the transverse adhesive strip 24, and bends the form about the third transverse fold line 20 (which preferably does not extend into the marginal portions 28–33), and presses the adhesive 24 into contact with the second face of the first section 12 adjacent the first transverse edge 15. The return envelope address indicia 54 is then clearly visible on the outside of the return envelope 58, as is the indicia 53 facilitating and suggesting the insertion of return address information on return envelope 58 by the user.

The intermediate 10, mailer 56, and return envelope 58 now having been described, the method of forming the mailer type business form 56 from a sheet of paper will now be set forth. The method comprises the steps of: (a) Forming first (26) and second (27) longitudinal lines of weakness in the sheet parallel to and adjacent, but spaced from, the first and second longitudinal edges 16, 17, respectively, the lines of weakness defining, with the longitudinal edges, longitudinal marginal portions 28–33. (b) Providing first (35, 37, 39) and second (36, 38, 39') longitudinal strips of pressure sensitive adhesive in the first and second longitudinal marginal portions 28–33, respectively of the first face 11, extending parallel to the first and second longitudinal edges 16, 17. (c) Providing third (42, 44) and fourth (43, 45) longitudinal strips of pressure sensitive adhesive disposed parallel to the first and second strips of adhesive, and disposed adjacent the first and second lines of weakness 26, 27 on the opposite side thereof from the first and second strips of adhesive, on the first face 11, the third and fourth longitudinal strips of adhesive disposed closer to the first transverse edge 15 than the second 21. (d) Providing a transverse adhesive strip 24 on the first face 11, perpendicular to the longitudinal edges 16, 17, and longitudinally spaced from the third and fourth strips of adhesive (42–45). (e) Providing a line of weakness 22 adjacent the transverse strip 24, on the opposite side thereof from the third and fourth strips of adhesive (42–45), to allow ready separation of the paper at that line. (f) Providing first and second transverse fold lines 18, 19, the first fold line 18 closer to the first transverse edge 15 and the second fold line 19 closer to the second transverse edge 21, to define a first section 12 between the first transverse edge 15 and the first fold line 18, a second section 13 between the first 18 and second 19 fold lines, and a third section 14 between the second fold line 19 and second transverse edge 21. (g) Feeding the sheet to a non-impact (e.g. laser) duplex printer to print indicia on both the first 11 and second 47 faces, including outgoing addressee address indicia 50 on the second face 47 in the third section 14, and return envelope address indicia 54 on the second face 47 in the first section 12. (h) Folding the sheet (e.g., with a conventional C-folder utilized with Moore SpeediSealer® pressure seal equipment) so that the first section 12 first face 11 overlies a part, but not all, of the second section 13 first face 11, and the marginal portions (28, 30; 29, 31) thereof are in engagement, and so that the third section 14 first face 11 overlies a portion of the second section 12 first face 11, and all of the first section 12 second face 47, with the marginal portions (28, 30, 32; 29, 31, 33) thereof in engagement; and (i) applying pressure (e.g., with the Moore SpeediSealer® pressure seal equipment) to the sheet at the longitudinal strips (35–39, 42–45) of pressure sensitive adhesive to seal the sheet into a mailer, the first and second sections forming a return envelope (58) and all of the sections forming an outgoing mailer (56).

Step (i) is practiced—particularly when Moore SpeediSealer® equipment is used—so that pressure is applied only in alignment with the longitudinal strips of adhesive, and not over the entire width of the form. Also, there preferably is a further step (j) of—between steps (h) and (i) of providing one or more inserts in the mailer. Also, step (g) is preferably practiced to also print return address information on the outgoing envelope, on the second face 47 of the third section 14, and indicia 53 facilitating and suggesting the insertion of return address information on the return envelope 58, on the second face 47 on both the second section 13 and third section 14.

Figure 6:
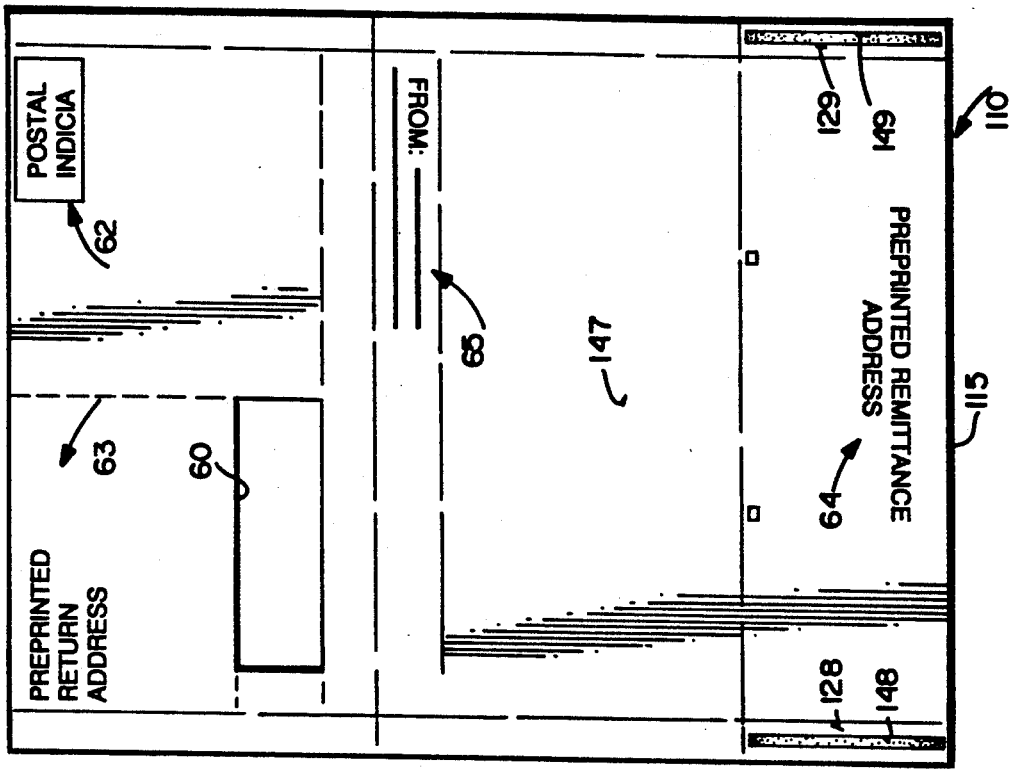
FIGS. 5 and 6 are views like those of FIGS. 1 and 2, respectively, only for a second exemplary embodiment of an intermediate according to the invention.
Figure 5:
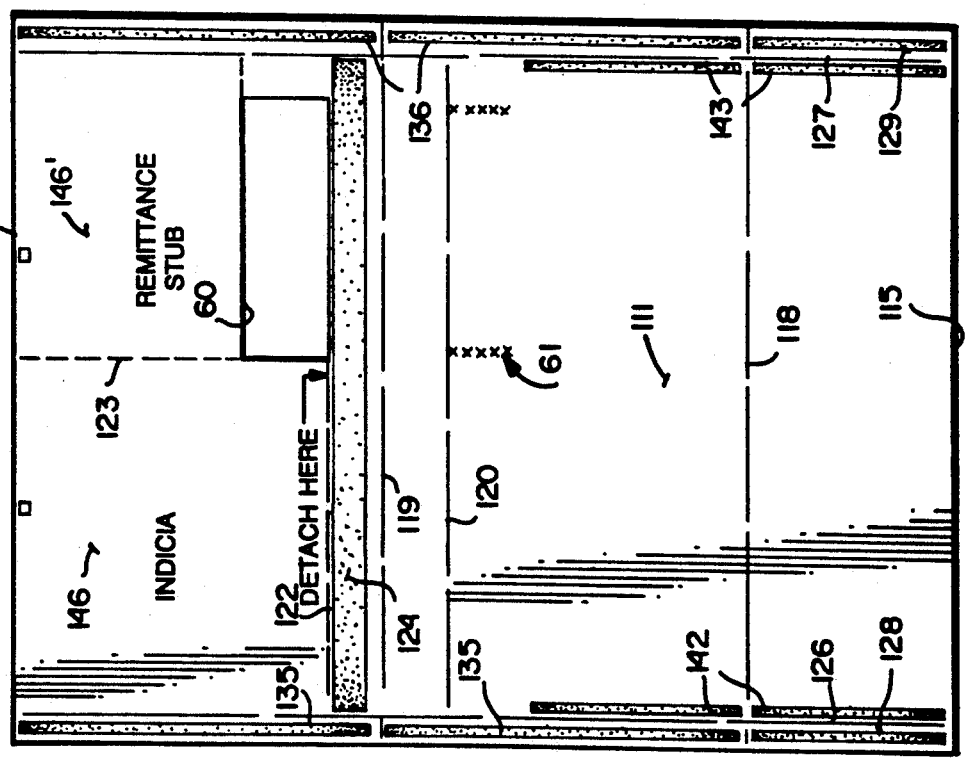

FIGS. 5 and 6 illustrate a second construction of mailer intermediate 110 according to the invention. In this embodiment, structures the same as those in the FIGS. 1 through 4 embodiment are illustrated by the same reference numeral only preceded by a "1". The common elements, with the "1" prefex numeral will not be described in detail, but rather only the different structures.

In the FIGS. 5 and 6 embodiment, a die cut window 60 is formed in the third section 114, adjacent the transverse line of weakness 122 and the longitudinal line of weakness 123, close to the second section 113. The outgoing addressee address information is printed at 61 on the first face 111 of the second section 113, at a portion thereof adjacent the third fold line 120, which will insure that the window 60 overlies the indicia 61 when a mailer is formed (the spacing between the perforation 122 and first fold line 119 being approximately the same as the spacing between the second and third fold lines 119, 120). In the FIG. 5 embodiment, the first and second longitudinal strips of adhesive 135, 136 do not have discontinuities 40, 41 such as illustrated in the FIG. 1 embodiment, since preferably the transverse ends 115, 121 of the intermediate 110 are connected in continuous format to like intermediates 110, and are fed through a continuous laser printer, rather than sheet fed. However, the intermediates 110 can be sheet fed too, in which case discontinuities like the discontinuities 40, 41 preferably are provided in the adhesive strips 135, 136.

On the second face 147 (FIG. 6) of the intermediate 110, the outgoing envelope return address 63, postal indicia 62, remittance address 64, and return address insertion facilitating indicia 65 are preprinted, since the intermediate 110 is used with a simplex printer rather than duplex printer, so that the only indicia capable of being printed thereby is on the first face 111.

A method of forming a mailer type business form with integral return envelope from a sheet of paper having first and second parallel longitudinal edges 116, 117, and first and second parallel transverse ends 115, 121, and first and second faces 111, 147 is provided. This method comprises the following steps: (a) Forming first (126) and second (127) longitudinal lines of weakness in the sheet parallel to and adjacent, but spaced from, the first and second longitudinal edges, respectively, the lines of weakness defining, with the longitudinal edges, longitudinal marginal portions 128, 129. (b) Providing first (135) and second (136) longitudinal strips of pressure sensitive adhesive in the first and second longitudinal marginal portions 128, 129, respectively, of the first face 111, extending parallel to the first and second longitudinal edges 116, 117. (c) Providing third (142) and fourth (143) longitudinal strips of pressure sensitive adhesive disposed parallel to the first and second lines of weakness 126, 127 on the opposite side thereof from the first and second strips of adhesive 135, 136, on the first face, the third and fourth longitudinal strips of adhesive disposed closer to the first transverse end 115 than the second 121. (d) Providing a transverse adhesive strip 124 on the first face, perpendicular to the longitudinal edges, longitudinally spaced from the third and fourth strips of adhesive 142, 143. (e) Providing a line of weakness 122 adjacent the transverse strip, on the opposite side thereof from the third and fourth strips of adhesive 142, 143, to allow ready separation of the paper at that line. (f) Providing first and second transverse fold lines 118, 119, the first fold line 118 closer to the first transverse end 115 and the second fold line 119 closer to the second transverse edge 121, to define a first section 112 between the first transverse edge and the first fold line, a second section 113 between the first and second fold lines, and a third section 114 between the second fold line and second transverse edge. (g) Die cutting a window 60 in the third section 114 at the portion thereof adapted to overlie outgoing addressee address indicia (61) once the mailer is formed. (h) Feeding the sheet 110 to a non-impact (e.g. continuous laser) simplex printer to print indicia on only the first face 111, including outgoing addressee address indicia 61 on the first face 111 in the second section 113. (i) Folding the sheet (e.g., with a conventional C-folder utilized with Moore SpeediSealer ® pressure seal equipment) so that the first section 112 first face overlies a part, but not the outgoing address indicia 61, of the second section 113 first face, and the marginal portions 128, 129 thereof are in engagement, and so that the third section 114 first face overlies a portion of the second section 113 first face so that the outgoing address indicia 61 is visible through the window 60 in the third section 114, and all of the first section 112 second face 147, with the marginal portions 128, 129 thereof in engagement; and (j) applying pressure (e.g., with the Moore SpeediSealer ® pressure seal equipment) to the sheet at the longitudinal strips 135, 136, 142, 143 of pressure sensitive adhesive to seal the sheet into a mailer, the first and second sections forming a return envelope and all of the sections forming an outgoing mailer.

It will thus be seen that according to the present invention an intermediate for a mailer type business form, a mailer type business form with integral return envelope, and methods of forming mailer type business form with integral return envelopes, are provided, which are simple and advantageous. While the invention has been herein shown and described in what is presently conceived to be the most practical preferred embodiment, it will be apparent to those of ordinary skill in the art that many modifications may be made thereof within the scope of the invention, which scope is to be accorded the broadest interpretation of the appended claims so as to encompass all equivalent products and procedures.

What is claimed is:

1. A mailer type business form intermediate, comprising:

a sheet of paper having a first face, adapted to provide the majority of the interior of the mailer when constructed, and a second face, adapted to provide the majority of the exterior of the mailer when constructed;

said sheet having first and second opposite, parallel longitudinal edges extending the entire length thereof, and opposite ends;

first and second longitudinal lines of weakness formed in said sheet parallel to and adjacent, but spaced from, said first and second longitudinal edges, respectively, said lines of weakness defining, with said longitudinal edges, longitudinal marginal portions;

first and second longitudinal strips of adhesive disposed in said first and second longitudinal marginal portions, respectively, of said first face, extending the majority of the lengths of said longitudinal marginal portions, and parallel to said first and second longitudinal edges;

third and fourth longitudinal strips of adhesive disposed parallel to said first and second strips, and disposed adjacent said first and second lines of weakness on the opposite side thereof from said first and second strips, on said first face, said third and fourth longitudinal strips disposed closer to one end of said ends than the other, and extending a distance substantially less than the extent of said first and second strips;

fifth and sixth longitudinal strips of adhesive parallel to said first and second longitudinal edges and disposed in said first and second marginal portions, respectively, on said second face, said fifth and sixth strips located adjacent the same end of said sheet as said third and fourth strips, and having a longitudinal extent at the most equal to said and fourth strips;

means defining a transverse adhesive strip on said first face, perpendicular to said third and fourth strips, longitudinally spaced from said third and fourth strips; and means defining a line of weakness adjacent said transverse strip, on the opposite side thereof from said third and fourth strips, to allow ready separation of the paper at that line.

2. An intermediate as recited in claim 1 wherein said first through sixth adhesive strips are of pressure sensitive adhesive.

3. An intermediate as recited in claim 2 wherein said third and fourth strips each have a longitudinal extent of about half the length of each of said first and second strips, and said fifth and sixth strips each have a longitudinal extent of about half the length of each of said third and fourth strips.

4. An intermediate as recited in claim 3 further comprising a first transverse fold line forming means disposed in said sheet at about the midpoint of said third and fourth strips, said third and fourth strips being discontinuous thereat.

5. An intermediate as recited in claim 4 further comprising second and third transverse fold line forming means disposed in said sheet on the opposite side of said transverse adhesive strip from said transverse line of weakness, and intersecting said first and second longitudinal adhesive strips, but not said third and fourth strips.

6. An intermediate as recited in claim 5 wherein said ends of said sheet are edges, and wherein said first and second strips have a break therein to facilitate feeding by a printer sheet feeder.

7. An intermediate as recited in claim 5 wherein said ends of said sheet: are lines of weakness releasably connected said sheet: to other sheets, in continuous form; and further comprising a die cut window formed in said sheet.

8. An intermediate as recited in claim 2 wherein said first through sixth adhesive strips are of pressure sensitive adhesive.

9. A mailer type business form, with integral return envelope, comprising:

a C-fold paper sheet having first and second faces, first and second opposite longitudinal edges extending the entire length thereof, and first and second transverse fold lines defining first, second and third sections of said sheet;

said second and third sections being larger than said first section;

first and second lines of weakness formed in said sheet parallel to and adjacent, but spaced from, said first and second longitudinal edges, respectively, said lines of weakness defining, with said longitudinal edges, longitudinal marginal portions;

first and second longitudinal strips of adhesive disposed in said first and second longitudinal marginal portions, respectively, of said first face, and parallel to said first and second longitudinal edges; said first and second longitudinal strips connecting at least said first and second sections, and said third and first sections, together at said longitudinal marginal portions;

third and fourth longitudinal strips of adhesive disposed parallel to said first and second strips, and disposed adjacent said first and second lines of weakness on the opposite side thereof from said first and second strips, on said first face, said third and fourth longitudinal strips connecting said first section to a part of said second section to form the sides of a return envelope;

means defining a transverse adhesive strip on said first face, perpendicular to said third and fourth strips, in said third section;

means defining a transverse line of weakness adjacent said transverse strip in said third section, on the opposite side thereof from said second section, to allow ready separation of the form at that line;

outgoing address, and outgoing return address, indicia visible from said second face of said third section;

return envelope address indicia printed on said second face in said first section; and indicia facilitating and suggesting the insertion of return address information on said return envelope, said facilitating and suggesting indicia printed on said second face in both said second and third sections.

10. A business form as recited in claim 9 wherein said longitudinal strips of adhesive are pressure sensitive adhesive.

11. A business form as recited in claim 9 further comprising means defining a longitudinal line of weakness in said third section, intersecting said transverse line of weakness.

12. A business form as recited in claim 9 further comprising at least one insert.

13. A business form as recited in claim 9 further comprising fifth and sixth longitudinal strips of adhesive parallel to said first and second edges disposed in said marginal portions of said first section on said second face.

14. A business form as recited in claim 9 further comprising at least one insert.

15. A business form as recited in claim 9 further comprising a third transverse fold line between said first and second fold liens in said second section, and not extending into said marginal portions.

16. A mailer type business form, with integral return envelope, comprising:

a C-fold paper sheet having first and second faces, first and second opposite longitudinal edges extending the entire length thereof, and first and second transverse fold lines defining first, second and third sections of said sheet;

a third transverse fold line between said first and second fold lines in said second section, and not extending into the marginal portions;

said second and third sections being larger than said first section;

first and second lines of weakness formed in said sheet parallel to and adjacent, but spaced from, said first and second longitudinal edges, respectively, said lines of weakness defining, with said longitudinal edges, longitudinal marginal portions;

first and second longitudinal strips of adhesive disposed in said first and second longitudinal marginal portions, respectively, of said first face, and parallel to said first and second longitudinal edges; said first and second longitudinal strips connecting at least said first and second sections, and said third and first sections, together at said longitudinal marginal portions;

third and fourth longitudinal strips of adhesive disposed parallel to said first and second strips, and disposed adjacent said first and second lines of weakness on the opposite side thereof from said first and second strips, on said first face, said third and fourth longitudinal strips connecting said first section to a part of said second section to form the sides of a return envelope;

means defining a transverse adhesive strip on said first face, perpendicular to said third and fourth strips, in said third section;

means defining a transverse line of weakness adjacent said transverse strip in said third section, on the opposite side thereof from said second section, to allow ready separation of the form at that line; and outgoing address, and outgoing return address, indicia visible from said second face of said third section.

17. A mailer type business form, with integral return envelope, comprising:

a C-fold paper sheet having first and second faces, first and second opposite longitudinal edges extending the entire length thereof, and first and second transverse fold lines defining first, second and third sections of said sheet;

said second and third sections being larger than said first section;

first and second lines of weakness formed in said sheet parallel to and adjacent, but spaced from, said first and second longitudinal edges, respectively, said lines of weakness defining, with said longitudinal edges, longitudinal marginal portions;

first and second longitudinal strips of adhesive disposed in said first and second longitudinal marginal portions, respectively, of said first face, and parallel to said first and second longitudinal edges; said first and second longitudinal strips connecting at least said first and second sections, and said third and first sections, together at said longitudinal marginal portions;

third and fourth longitudinal strips of adhesive disposed parallel to said first and second strips, and disposed adjacent said first and second lines of weakness on the opposite side thereof from said first and second strips, on said first face, said third and fourth longitudinal strips connecting said first section to a part of said second section to form the sides of a return envelope;

means defining a transverse adhesive strip on said first face, perpendicular to said third and fourth strips, in said third section;

means defining a transverse line of weakness adjacent said transverse strip in said third section, on the opposite side thereof from said second section, to allow ready separation of the form at that line; and outgoing addressee address indicia printed on said first face in said second section, and means defining a die cut window in said third section allowing viewing of said outgoing addressee address information therethrough.

18. A business form as recited in claim 17 further comprising preprinted outgoing return address information printed on said second face in said third section.

19. A mailer type business form, with integral return envelope, comprising:

a C-fold paper sheet having first and second faces, first and second opposite longitudinal edges extending the entire length thereof, and first and second transverse fold lines defining first, second and third sections of said sheet;

said second and third sections being larger than said first section;

first and second lines of weakness formed in said sheet parallel to and adjacent, but spaced from, said first and second longitudinal edges, respectively, said lines of weakness defining, with said longitudinal edges, longitudinal marginal portions;

first and second longitudinal strips of adhesive disposed in said first and second longitudinal marginal portions, respectively, of said first face, and parallel to said first and second longitudinal edges; said first and second longitudinal strips connecting at least said first and second sections, and said third and first sections, together at said longitudinal marginal portions;

third and fourth longitudinal strips of adhesive disposed parallel to said first and second strips, and disposed adjacent said first and second lines of weakness on the opposite side thereof from said first and second strips, on said first face, said third and fourth longitudinal strips connecting said first section to a part of said second section to form the sides of a return envelope;

means defining a transverse adhesive strip on said first face, perpendicular to said third and fourth strips, in said third section;

means defining a transverse line of weakness adjacent said transverse strip in said third section, on the opposite side thereof from said second section, to allow ready separation of the form at that line;

outgoing address, and outgoing return address, indicia visible from said second face of said third section;

wherein said longitudinal strips of adhesive are pressure sensitive adhesive; and a third transverse fold line between said first and second fold lines in said second section, and not extending into said marginal portions.

* * * * *